US006843658B2

(12) United States Patent
Kuwabara et al.

(10) Patent No.: US 6,843,658 B2
(45) Date of Patent: Jan. 18, 2005

(54) ELECTRIC CONNECTOR FOR CONNECTING ELECTRONIC INSTRUMENTS

(75) Inventors: Atsushi Kuwabara, Yamanashi-ken (JP); Tsutomu Ojima, Iwate-ken (JP)

(73) Assignee: Citizen Electronics Co., Ltd., Fujiyoshida (JP)

( * ) Notice: Subject to any disclaimer, the term of this patent is extended or adjusted under 35 U.S.C. 154(b) by 0 days.

(21) Appl. No.: 10/396,724

(22) Filed: Mar. 26, 2003

(65) Prior Publication Data

US 2003/0186567 A1 Oct. 2, 2003

(30) Foreign Application Priority Data

Apr. 2, 2002 (JP) ..... 2002-100603
May 27, 2002 (JP) ..... 2002-151647

(51) Int. Cl.[7] ..... H01R 12/00
(52) U.S. Cl. ..... 439/66

(58) Field of Search ..... 439/66, 61, 75, 439/81, 83, 91

(56) References Cited

U.S. PATENT DOCUMENTS 4,961,709 A * 10/1990 Noschese ..... 439/66
5,167,512 A * 12/1992 Walkup ..... 439/66
6,224,396 B1 * 5/2001 Chan et al. ..... 439/71
6,296,495 B1 * 10/2001 Wang et al. ..... 439/71

* cited by examiner

*Primary Examiner*—Gary Paumen
(74) *Attorney, Agent, or Firm*—Dennison, Schultz, Dougherty & MacDonald

(57) ABSTRACT

An electric connector has a frame made of insulation, and a double-ended volute spring composed by an outermost base cylinder, and a pair of volute spring portions extending from the base cylinder so as to be contact with terminals of an electronic instrument. The base cylinder is secured in a hole formed in the frame.

5 Claims, 7 Drawing Sheets

ELECTRIC CONNECTOR FOR CONNECTING ELECTRONIC INSTRUMENTS

BACKGROUND OF THE INVENTION

The present invention relates to an electric connector for an electronic instrument such as a portable telephone.

In the portable telephone, a microphone is connected to terminals on a circuit substrate by electric connectors. In a conventional portable telephone, the microphone is connected to terminals by coil springs. The coil spring is compressed between a terminal of the microphone and a terminal of the substrate so as to connect both the terminals.

However, there in a problem that when the coil spring is compressed, the position of the end of the coil deviates from a desired position. In order to ensure the connection, the terminal must be formed into a large size, which obstructs the miniaturization of the telephone.

SUMMARY OF THE INVENTION

An object of the present invention is to provide an electric connector which may exactly connect terminals at a mall connecting area.

According to the present invention, there is provided an electric connector comprising a frame made of insulation, a volute spring composed by an outermost base cylinder, and at least one volute spring portion extending from the base cylinder so as to be contact with a terminal of an electronic instrument, holding meant for holding the base cylinder in the frame.

The volute spring has an end cylindrical portion on an outer end of the volute spring portion.

The holding means comprises a flange formed on the base cylinder, a shoulder formed on an inside wall of a hole formed in the frame, engaged with one of sides of the flange, and a cover engaged with other side of the flange.

In another aspect, the holding means comprises a tab projected from the base cylinder, and a triangular engaging projection to be engaged to an inside wall of a hole formed in the frame.

The electric connector further comprises a contact portion formed on an end of the volute spring portion, the contact portion has a plurality of triangular projections so as to be engaged with the terminal.

These and other objects and features of the present invention will become more apparent from the following detailed description with reference to the accompanying drawings.

DETAILED DESCRIPTION OF THE PREFERRED EMBODIMENT

Figure 1:
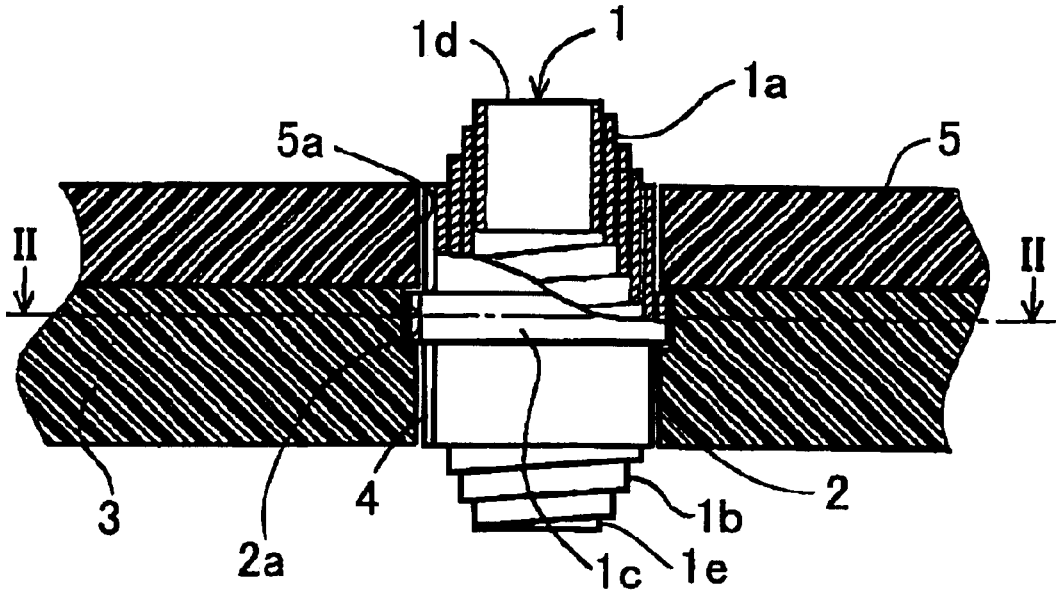
FIG. 1 is a sectional view of an electric connector according to a first embodiment of the present invention.
Figure 2:
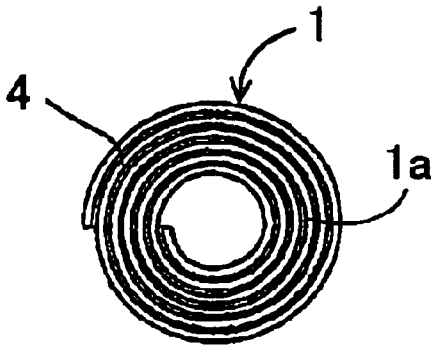
FIG. 2 is a sectional view of the electric connector taken along a line II—II of FIG. 1.

Referring to FIG. 1 showing an electric connector according to a first embodiment of the present invention, a double-ended volute spring 1 is securely mounted in a hole 2 formed in a frame 3 made of insulation. The volute spring 1 comprises an outermost base cylinder 4, upper and lower volute spring portions 1*a* and 1*b* spirally extending from base cylinder 4, and upper and lower end cylindrical portions 1*d* and 1*e*. A flange 1*c* is provided on the base cylinder 4 which is held by a shoulder 2*a* of the hole 2 and an edge of a hole 5*a* of a cover 5 made of insulation, so that the volute spring 1 is secured to the frame 3.

Figure 3:
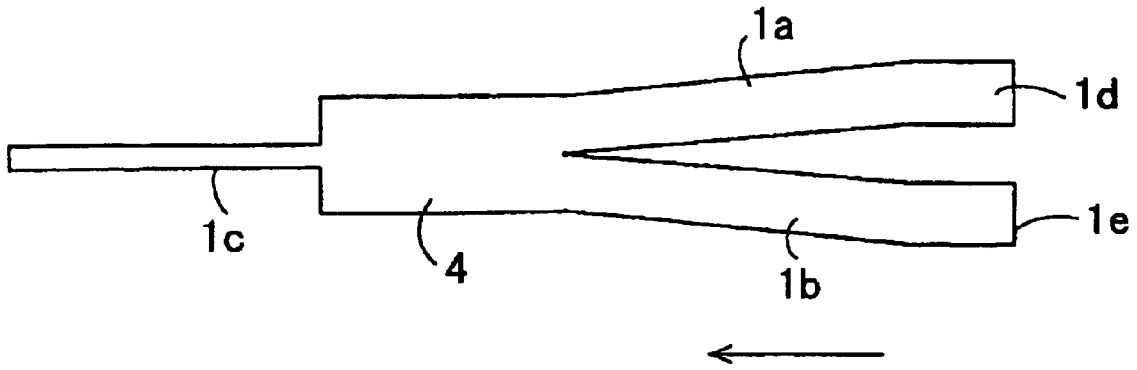
FIG. 3 is a development of the double-ended volute spring.

FIG. 3 is a development of the double-ended volute spring. The blank has a substantially Y-shape. The blank is wound from the upper and lower end cylindrical portions 1*d* and 1*a* on a core (not shown) in the direction shown by an arrow. The inclined branch portions form the volute spring portions 1*a* and 1*b*.

Figure 4:
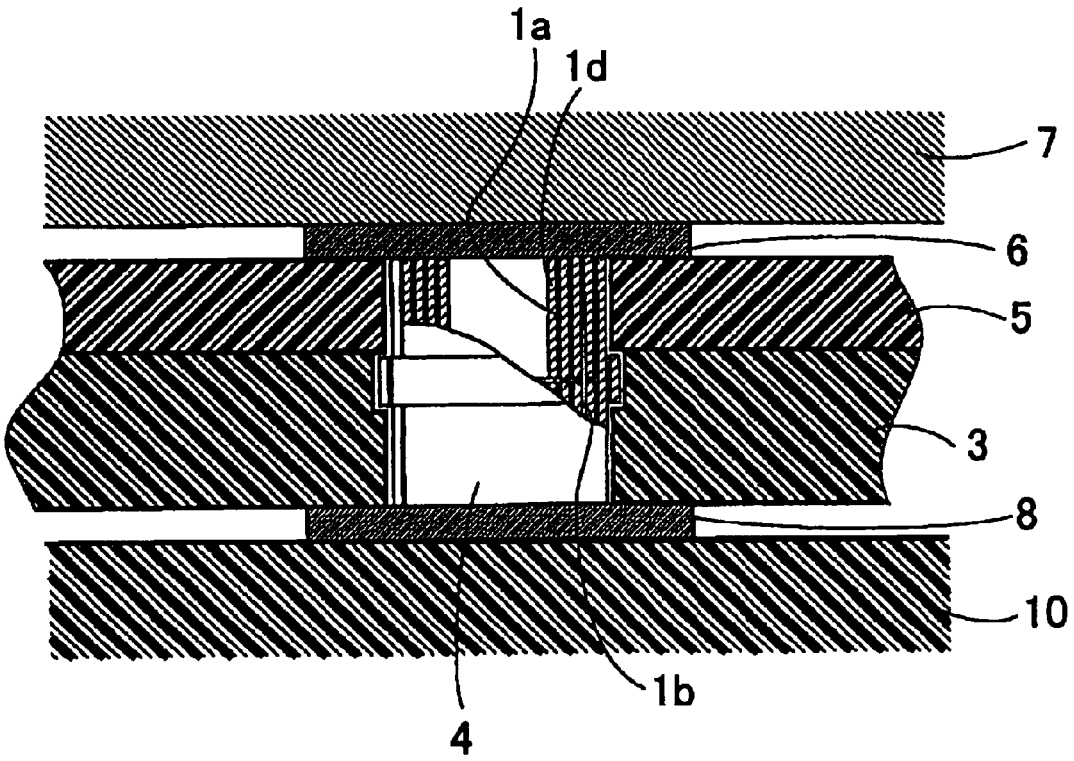
FIG. 4 is a sectional view showing a condition that the volute spring is used for connecting electronic instruments.

FIG. 4 is a sectional view showing a condition that the volute spring is used for connecting electronic instruments. The volute spring is provided between a terminal 6 of a microphone 7 and a terminal 8 of a substrate 10. As viewed in the figure, edges of end cylindrical portions 1*d* and 1*e*, and volute spring portions 1*a* and 1*b* are pressed against the terminals 6 and 8, thereby exactly connecting both terminals.

Figure 5A:
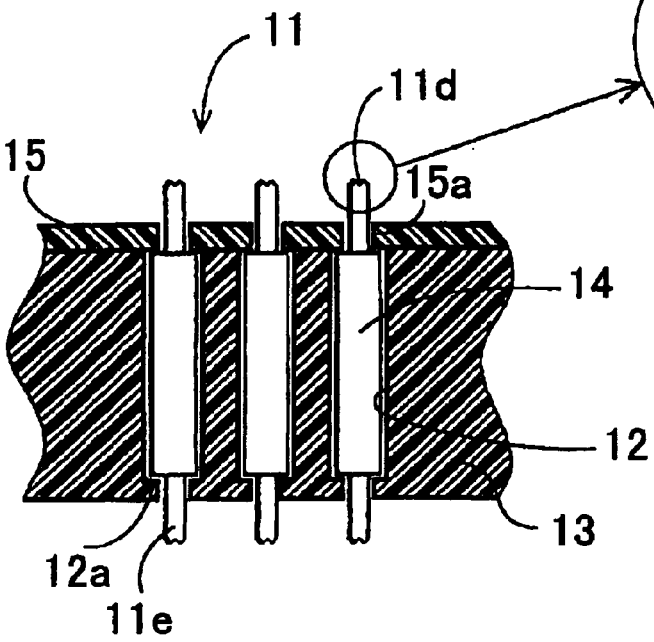
FIG. 5*a* is a sectional view showing a second embodiment of the present invention.
Figure 6:
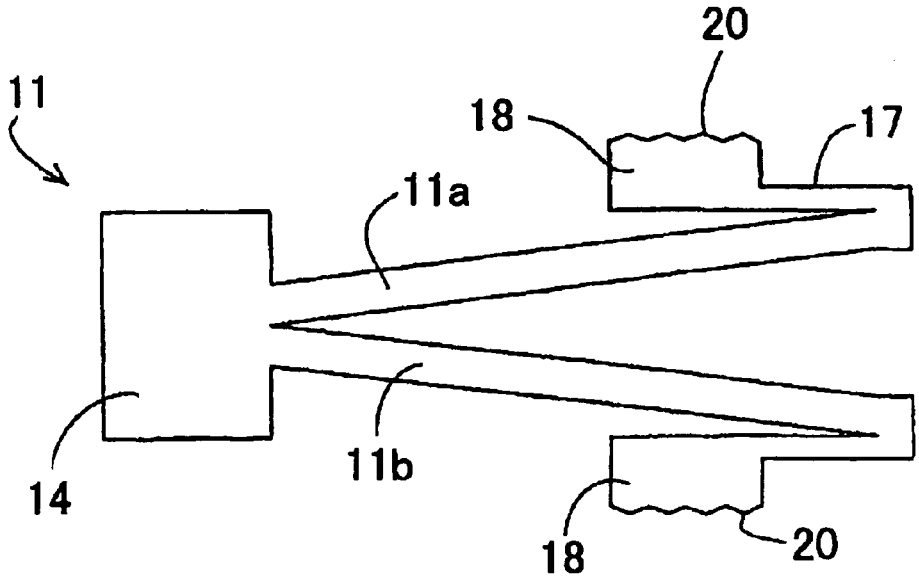
FIG. 6 is a development oil the double-ended volute spring.

FIG. 5*a* is a sectional view showing a second embodiment of the present invention, and FIG. 6 is a development of the double-ended volute spring. The double-ended volute spring 11 is securely mounted in a hole 12 formed in a frame 13. The volute spring 11 comprises an outermost base cylinder 14, upper and lower volute spring portions 11*a* and 11*b* and upper and lower end cylindrical portions lid and 11*e*. The base cylinder 14 is held by a shoulder 12*a* of the hole 12 and an edge of a hole 15*a* of a cover 15, so that the volute spring 11 is secured to the frame 13.

Figure 5B:
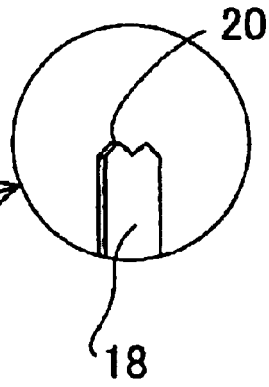
FIG. 5*b* is an enlarged view of a part of FIG. 5*a;*

As shown in FIG. 6, a branch 17 is extended in the reverse direction from the end of each of the spring portions 11*a* and 11*b*. A contact portion 18 is formed at an end of the branch 17. The contact portion 18 has a plurality of triangular projections 20 which are arranged in the direction perpendicular to the axis of the volute spring As shown in FIG. 5*b*, the contact portion 19 is wound in a cylindrical form. Thus, the projections 20 further ensure the connection between the volute spring and a terminal of an electronic instrument.

Figure 7:
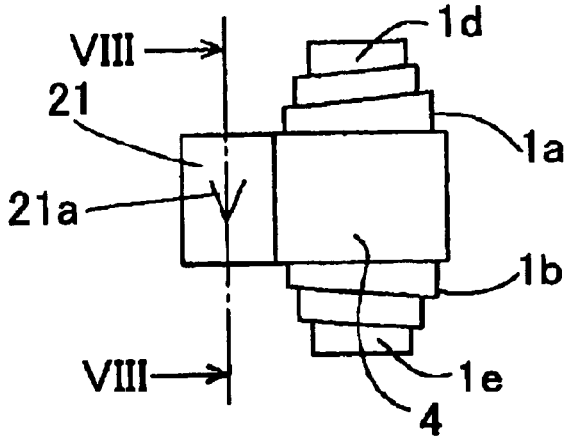
FIG. 7 is a side view showing a volute spring according to a third embodiment.
Figure 8:
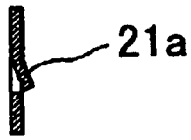
FIG. 8 is a sectional view taken along a line VIII—VIII of FIG. 7.
Figure 9:
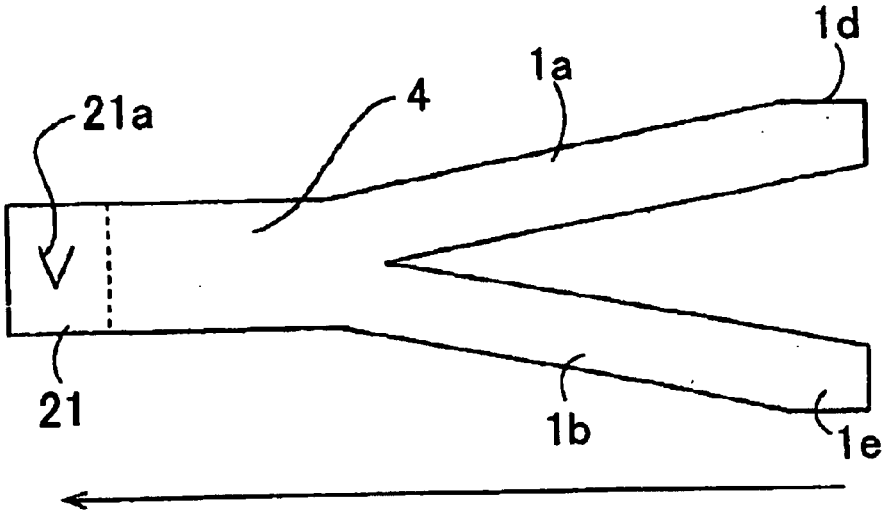
FIG. 9 is a development of the volute spring.

FIG. 7 is a side view showing a volute spring according to a third embodiment, and FIG. 9 is a development of the volute spring. The same reference numerals as those of FIG. 1 are used in the figures so that detailed explanations are omitted.

A securing tab 21 is projected from the base cylinder 4 in the horizontal direction for securing the volute spring 1 to the frame 3. A triangular engaging projection 21*a* is formed on the tab 21.

Figure 10:
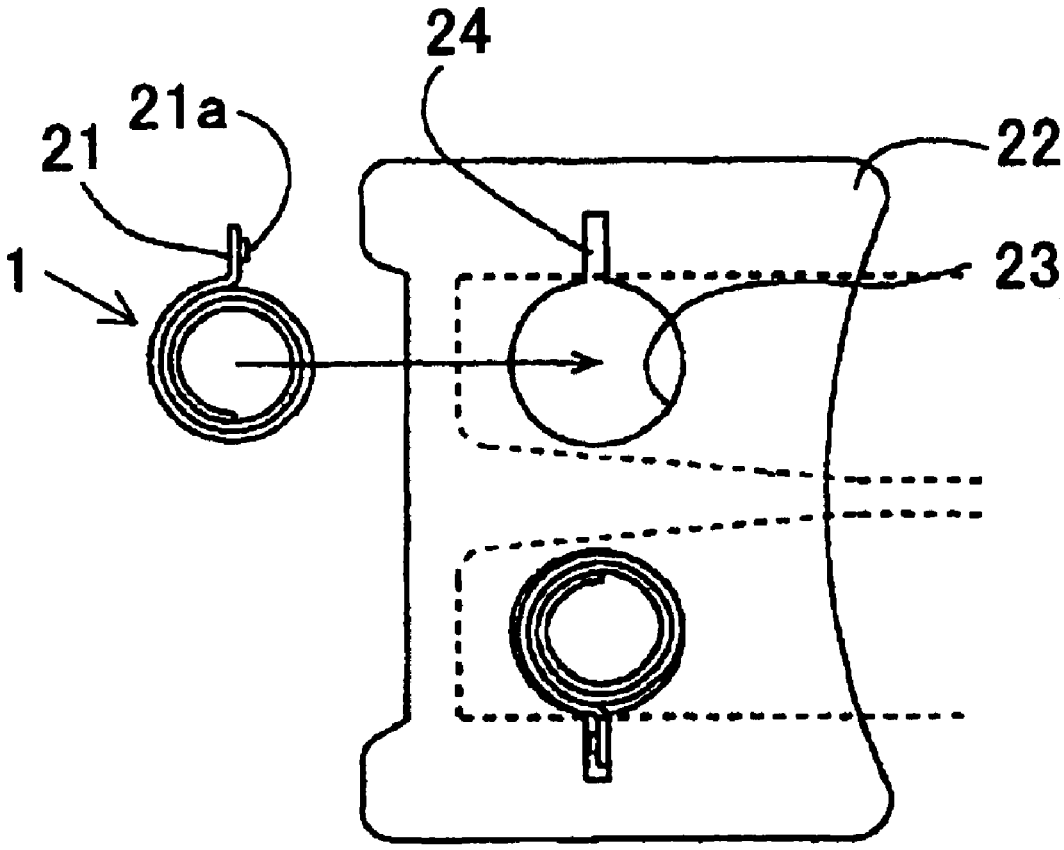
FIG. 10 is a plan view showing an insertion operation of the volute spring in an electronic instrument.
Figure 11:
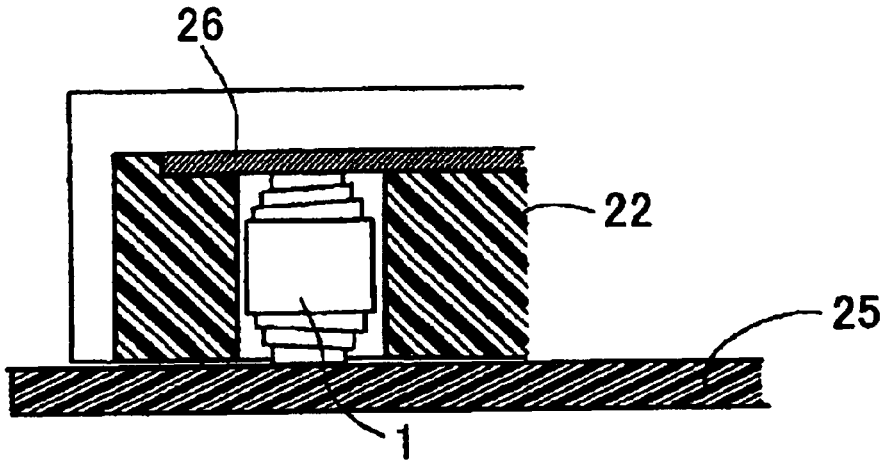
FIG. 11 is a sectional view showing an inserted condition.

FIG. 10 is a plan view showing an insertion operation of the volute spring 1 in an electronic instrument, and FIG. 11 is a sectional view showing an inserted condition.

As shown in FIGS. 10 and 11, in a frame 22 made of resin, a pair of holes 23 are formed for the volute spring 1. As shown in FIG. 10, in each hole 23, a slit 24 is formed in a radial direction of the hole. The volute spring 1 is inserted in the hole 23, engaging the triangular engaging projection 21*a* with the inside wall of the hole 23. Thus, volute spring 1 is fixed to the frame 22. As shown in FIG. 11, the volute spring 1 is engaged with a lead frame 26 of an electronic instrument and a terminal of a substrate 25.

Figure 12:
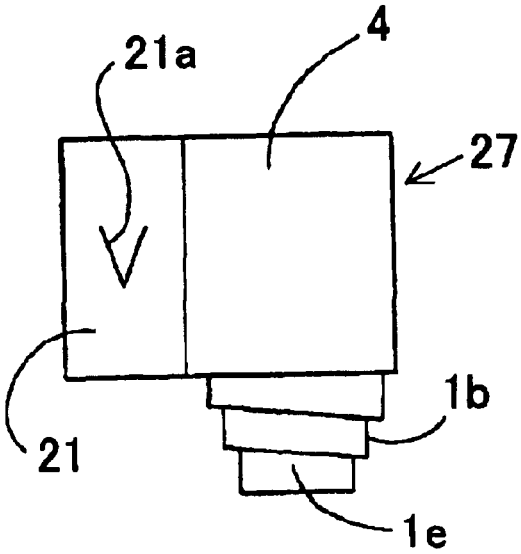
FIG. 12 is a side view showing a fourth embodiment.

FIG. 12 in a side view showing a fourth embodiment. The spring is a single-ended volute spring 27. The volute spring 27 has the same tab 21 as the third embodiment. Other parts are designated by the same reference numerals as the first embodiment.

Figure 13:
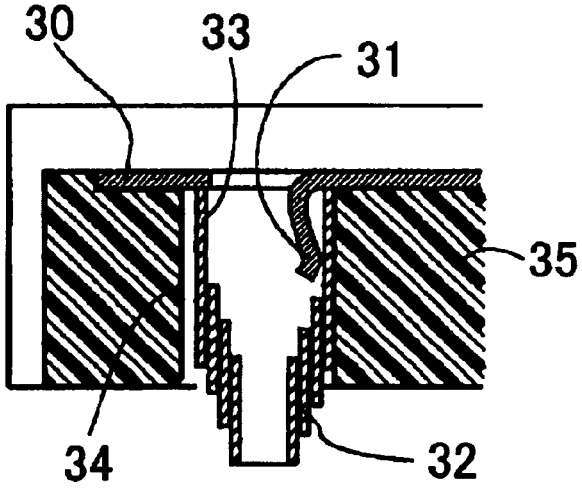
FIGS. 13 and 14 are sectional views showing means for holding and connecting the single-ended volute springs to terminals.
Figure 14:
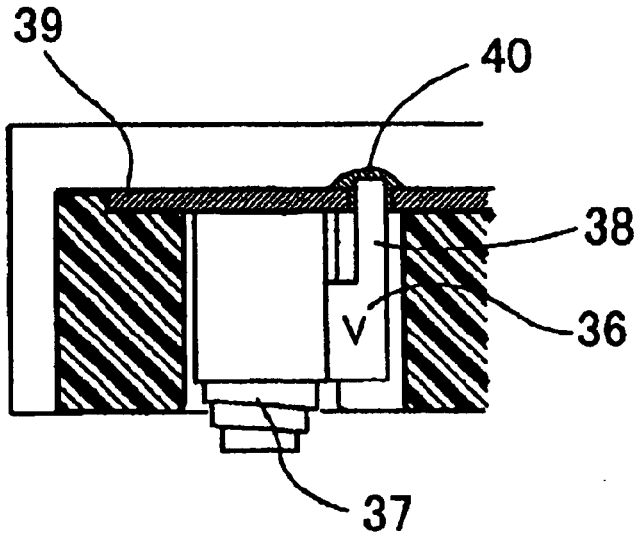

FIGS. 13 and 14 are sectional views showing means for holding and connecting the single-ended volute springs to terminals.

In the means of FIG. 13, a terminal 30 has a holding spring projection 31. The spring projection 31 is inserted in a volute spring 32 to press a bases cylinder 33 against an inner wall of a hole 34 of a frame 35, thereby holding and connecting the volute spring 32 to the terminal 30.

In the means of FIG. 14, a tab 36 of a volute spring 37 has a securing projection 38. The projection 38 is inserted in a hole of a terminal 39 and fixed to the terminal by a solder 40.

In accordance with the present invention, the outermost base cylinder of the volute spring is held in the frame, so that the volute spring does not deviate from a terminal. Therefore, the electrical connection between the terminal and the volute spring is exactly kept. Furthermore, since the size of the terminal can be reduced, the electronic instrument can be miniaturized.

While the invention has been described in conjunction with preferred specific embodiment thereof, it will be understood that this description is intended to illustrate and not limit the scope of the invention, which is defined by the following claims.

What is claimed is:

1. An electric connector comprising:

a frame made of insulation and having a hole;

a volute spring composed by an outermost base cylinder, inserted in the hole of the frame, and at least one volute spring portion extending from the base cylinder so as to contact with a terminal of an electronic instrument; and holding means for holding the base cylinder in the frame, wherein the holding means comprises a projection projected from the base cylinder and a recess formed in the frame and engaged with the projection.

2. An electric connector comprising:

a frame made of insulation having a hole;

a volute spring composed by an outermost base cylinder, inserted in the hole of the frame, and at least one volute spring portion extending from the base cylinder so as to contact with a terminal of an electronic instrument; and holding means for holding the base cylinder in the frame, wherein the holding means comprises an end face of the base cylinder and a shoulder formed in the frame and engaged with the end face.

3. The electric connector according to claim 2, further comprising a contact portion formed on an end of the volute spring portion, a plurality of triangular projections formed on an outer side of the contact portion so as to be engaged with the terminal.

4. An electric connector comprising:

a frame made of insulation having a hole;

a volute spring composed by an outermost base cylinder, inserted in the hole of the frame, and a volute spring portion extending from the base cylinder so as to contact with a terminal of an electronic instrument; and holding means for holding the base cylinder in the frame, wherein the holding means comprises a projection projected from the base cylinder and a hole formed in the terminal and engaged with the projection.

5. An electric connector comprising:

a frame made of insulation having a hole;

a volute spring composed by an outermost base cylinder, inserted in the hole of the frame, and a volute spring portion extending from the base cylinder so as to contact with a terminal of an electronic instrument; and holding means for holding the base cylinder in the frame, wherein the holding means comprises a holding spring projection projected from the terminal for pressing the base cylinder against an inside wall of a hole of the frame.

* * * * *